US006647896B1

(12) United States Patent
Nottingham et al.

(10) Patent No.: US 6,647,896 B1
(45) Date of Patent: Nov. 18, 2003

(54) GREASELESS HANGER ASSEMBLY FOR A RAILCAR DOOR

(75) Inventors: Scot J. Nottingham, Greenville, PA (US); Robert Jackson, Coloma, MI (US)

(73) Assignee: YSD Industries, Inc., Youngstown, OH (US)

( * ) Notice: Subject to any disclaimer, the term of this patent is extended or adjusted under 35 U.S.C. 154(b) by 3 days.

(21) Appl. No.: 10/047,098

(22) Filed: Jan. 14, 2002

(51) Int. Cl.[7] ..... B61D 17/00

(52) U.S. Cl. ..... 105/378; 49/218; 384/107; 16/104

(58) Field of Search ..... 105/258, 276, 105/282.1, 377.09, 377.1, 378; 49/218, 220, 221, 223; 384/261, 107, 262, 282, 299, 297, 276, 298, 300, 303; 16/93 R, 98, 103, 106, 104, 108

(56) References Cited

U.S. PATENT DOCUMENTS 3,106,000 A * 10/1963 Beallchamp ..... 49/220
3,912,312 A * 10/1975 Cerutti ..... 292/218
4,064,810 A 12/1977 Jenkins et al.
4,215,515 A * 8/1980 Hesch et al. ..... 49/218
4,319,429 A 3/1982 Seitz
4,457,046 A * 7/1984 Vater ..... 16/95 R
4,607,965 A * 8/1986 Belanger ..... 384/299
5,035,051 A * 7/1991 Iijima ..... 29/898.054
5,758,977 A * 6/1998 Bickle et al. ..... 384/276
6,370,734 B1 * 4/2002 Ryan ..... 16/93 R

* cited by examiner

*Primary Examiner*—Mark T. Le
(74) *Attorney, Agent, or Firm*—Fay, Sharpe, Fagan, Minnich & McKee, LLP

(57) ABSTRACT

A railway car door (10) includes a substantially planar door (14) and a pair of elongated support members (18) which are rotatably mounted to the door. A drive mechanism (50) is operatively associated with the railcar door for imparting rotational forces on the support members. A pair of greaseless crank (22*b*) and roller hanger assemblies (26) movably support the door member on a track (24). Each crank assembly includes a crank pin (96) having a shaft portion 100 with a peripheral recess (114) closely embraced by a self-lubricating sleeve (116). Each roller hanger assembly includes a housing (102) having a well or channel (106) with at least one self-lubricating annular member or washer (120) disposed at the bottom wall (122) thereof. The peripheral recess (114) of the crank pin shaft portion with sleeve (116) are closely rotatably received in bore or channel (106) with the outer terminal end face (124) of the crank pin shaft portion placed in engagement with the at least one annular member or washer (120).

13 Claims, 3 Drawing Sheets

GREASELESS HANGER ASSEMBLY FOR A RAILCAR DOOR

BACKGROUND OF THE INVENTION

The present invention relates generally to the art of railway car doors. More particularly, the invention pertains to a greaseless hanger assembly for plug-type railway car doors, and will be described with particular reference thereto. However, it is to be appreciated that the invention is also applicable to other related environments where a hanger assembly and crank are employed in conjunction with a rotating member or shaft.

Typical plug-type railway car doors are mounted on the side of a railway car and include a series of panels or sheeting reinforced by horizontally disposed channels at the top, bottom and intermediate portions of the door. A pair of vertically oriented elongated support members such as pipes, rods or bars are configured to support the door on the railway car itself. The elongated support members are typically provided with upper and lower cranks attached to the ends thereof which serve as lever arms for laterally moving the door into and out of an opening defined in the car. Upon actuation of a driving mechanism, such as a manually operated gear assembly, the support members are rotated causing corresponding rotation of the upper and lower cranks. Rotation of the cranks, in turn, draws the door laterally from the door opening until the door is supported on a track disposed adjacent a side of the car. The door is moveably supported on the track by roller hangers which enable the door to slide longitudinally along the side of the car.

More particularly, the lower cranks connect the elongated support members to each respective roller hanger assembly. The lower cranks include a crank end in the form of a pin portion secured to the bottom of the corresponding support member, a crank arm, and a crank pin. Typically, the crank pin is rotatably mounted to the roller hanger assembly. The portion of the roller hanger assembly that receives the crank pin includes a fitting surrounding the crank pin for retaining a lubricant. Grease is commonly used as the lubricant for providing substantially friction-free rotation of the crank pin within the roller hanger assembly. Grease, however, has several disadvantages.

First, grease is difficult to maintain and seal, often leaking or escaping from its intended working environment. Thus, grease filled hanger assemblies must be continuously monitored to ensure the continued presence of lubricant. Second, grease degrades over time, especially when exposed to harsh environments such as those experienced by railway cars and, thus, must be periodically replaced. Ensuring periodic maintenance is quite cumbersome because there is no easy and convenient place for servicing railway cars and there is no simple tracking method for determining when such maintenance should be implemented. Typically, railway cars remain on the tracks for extended periods of time at diverse locations, thereby making is difficult to maintain any regular maintenance schedule. Third, it is relatively expensive to maintain grease filled hanger assemblies, especially when the cost is calculated over the life of the railway car.

Accordingly, it has been considered desirable to develop a crank and hanger assembly for plug-type railway car doors that addresses the foregoing difficulties and others while providing better and more advantageous overall results.

SUMMARY OF THE INVENTION

In accordance with one aspect of the invention, a railway car door assembly includes a substantially planar door member and a pair of elongated support members which are rotatably mounted to the door member. An associated drive mechanism is employed to selectively impart a rotational force to the support members for shifting the door between fully closed and cracked positions. A pair of greaseless crank and roller hanger assemblies support the door on a track in the cracked position for movement therealong toward a fully opened position.

In accordance with a more specific aspect of the invention, each of the greaseless crank and roller hanger assemblies includes a crank comprised of a crank arm secured at one end to the corresponding elongated support member and a crank pin cooperatively connected thereto at the other end. The crank pin includes an inner portion secured to the crank arm and an outer shaft portion. The shaft portion includes a peripherally recessed area extending along an axial segment thereof, and a self-lubricating sleeve closely embraces the recessed area.

According to yet a further aspect of the invention, the self-lubricating sleeve is comprised of a high-density polyethylene material.

In accordance with another aspect of the invention, the greaseless roller hanger assembly includes a housing having a channel or well for receiving the crank pin shaft portion and a roller mounted to the housing for rotational movement along the track.

According to still another aspect of the invention, the greaseless roller hanger assembly includes at least one self-lubricating washer disposed at the bottom wall of the channel or well. In one arrangement, multiple oil-impregnated washers, preferably of bronze or similar material, are used and are disposed in a stacked relationship to each other. In another arrangement, a single self-lubricating washer comprised of a high-density polyethylene material is used.

Another aspect of the invention contemplates a method for greaseless mounting of a crank assembly for selective rotation relative to a roller hanger assembly. The method comprises the steps of substantially surrounding a portion of a crank pin with a polyethylene sleeve and positioning a polyethylene washer at the bottom wall of a channel or well within the roller hanger assembly. The crank pin is positioned in cooperating relation with the channel such that a bottom face of the crank pin is in contacting relation with the polyethylene washer and a portion of the polyethylene sleeve is in contacting relation with the inner wall or surface of the channel.

A principal advantage of the present invention resides in the provision of a crank and roller hanger assembly which operates effectively without the need for or use of a separate lubricant.

Another advantage of the invention is found in the provision of a crank and roller hanger assembly that is easy to maintain.

Still another advantage of the invention resides in the provision of a crank and roller hanger assembly that is relatively cost effective.

Still other benefits and advantages of the invention will become apparent to those skilled in the art upon a reading and understanding of the detailed specification.

BRIEF DESCRIPTION OF THE DRAWINGS

The invention may take physical form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENTS

Figure 1:
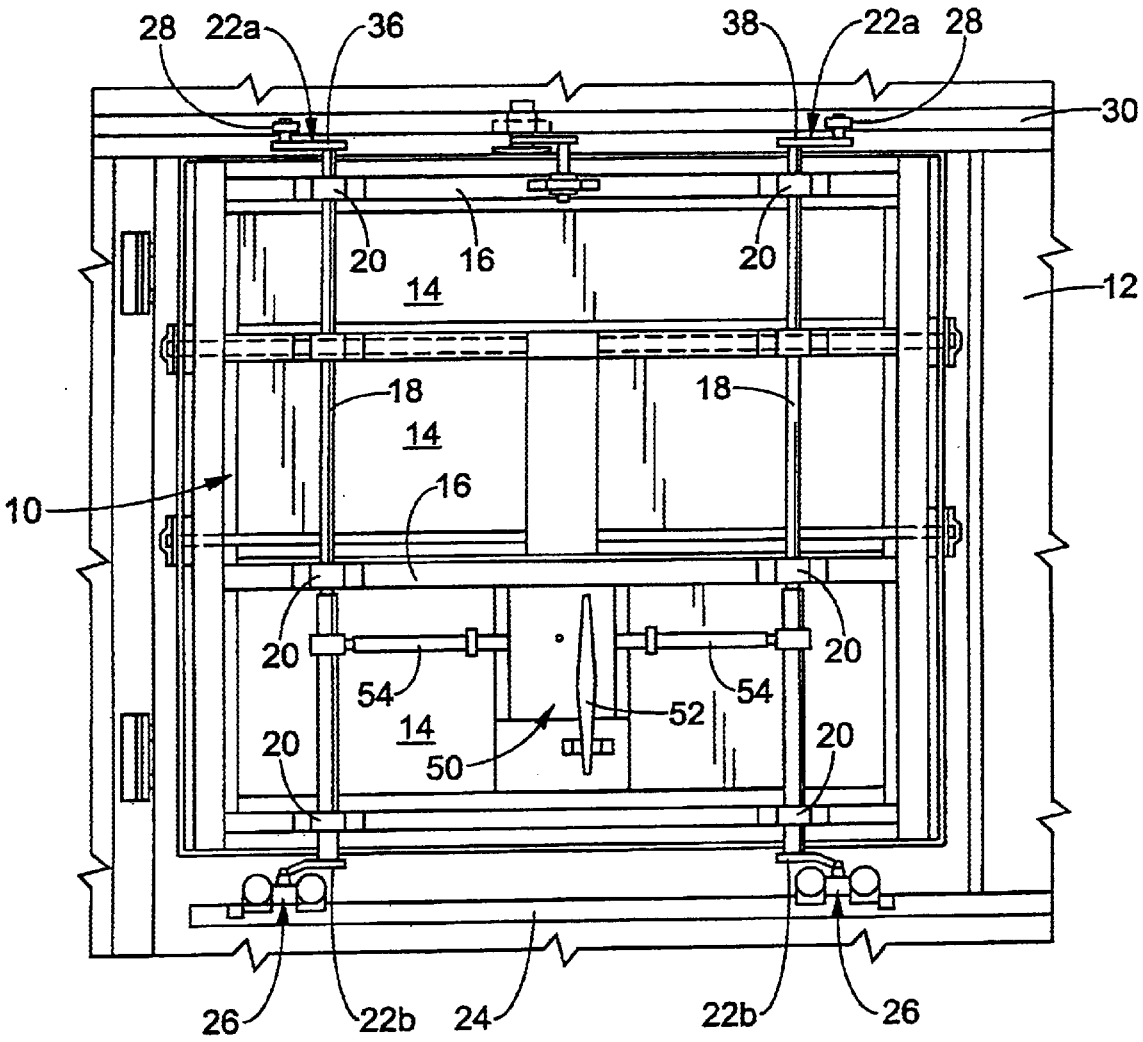
FIG. 1 is a front elevational view of a railcar door which includes the greaseless hanger assembly formed in accordance with the present invention.

Referring now to the drawings wherein the showings are for purposes of illustrating a preferred embodiment of the invention only and not for purposes of limiting same, FIG. 1 shows a plug-type railcar door 10 disposed in an opening 12 in a railcar in accordance with the preferred embodiment of the present invention. The door includes a wall of panels 14 reinforced with horizontal channels 16 extending across top, bottom and intermediate portions of the panels. The panels 14 are typically fabricated from metal sheeting.

The door 10 is supported by a pair of elongated support members 18, such as pipes, rods or tubes, which are disposed along the vertical height of the door. The support members are rotatably mounted to the horizontal reinforcing channels on an outer surface of the door via brackets or fulcrums 20 located near the side edges of the door to retain the support members in a vertical disposition.

Each of the support members 18 includes a first or upper end having a first or upper crank 22*a* operatively connected thereto and a second or lower end having a second or lower crank 22*b* likewise operatively connected thereto. The cranks 22*a*, 22*b* serve as lever arms which enable the door to be moved laterally into and out of closing relation with the railcar opening 12. The door 10 is adapted to move laterally out of the door opening toward the outside of the railcar until the door is supported on an elongated track 24 disposed adjacent the railcar side wall. The door is moved on the track longitudinally along the side of the car for effectively exposing the door opening and thereby facilitating car loading and unloading. In the unplugged position, the door is movably supported and guided on the track 24 by roller hangers 26 which are secured to the terminal ends of the lower cranks 22*b*.

Upper ends of cranks 22*a* include pins with rollers 28 mounted for longitudinal movement within an upper retainer rail or longitudinal retainer member 30 having a generally C-shaped cross-section. The upper retainer rail 30 is mounted along the top of the door opening 12 and functions to restrain the top of the door and prevent its undesired displacement. Generally horizontal connecting portions 36, 38 of upper cranks 22*a* connect the upper ends of the cranks and their rollers 28 with the upper ends of support members 18. The combination of the rollers 28 and the retainer rail 30 acts to restrain the top of the car door 10 as it is moved longitudinally along the track 22.

As is well understood in the art, rotation of the support members 18 will cause a corresponding outward rotation of the cranks 22*a*, 22*b* to sequentially draw the door 10 laterally outward from the door opening. An operating mechanism generally designated 50 is provided on the door for controlling the rotation of the support members and cranks in a manner well known in the art. An activating member 52 in, for example, the form of a handle is used to control the operating mechanism through a linkage and transmission arms 54.

Figure 2:
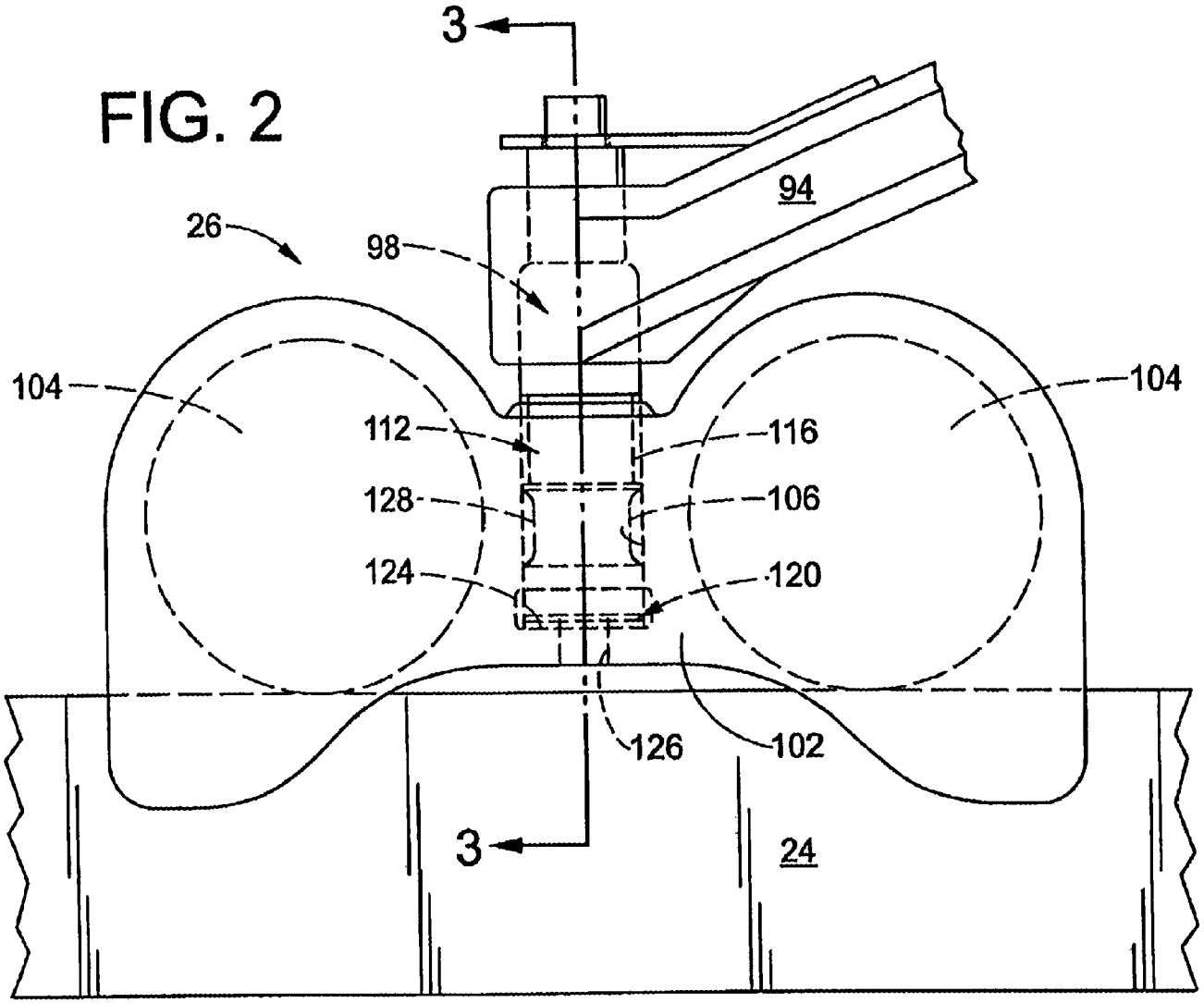
FIG. 2 is an enlarged elevational view of a greaseless crank and roller hanger assembly formed according to the invention.

With reference to FIG. 2, and with continued reference to FIG. 1, a greaseless roller hanger assembly 26 for receiving a lower crank assembly 22*b* is illustrated. Each lower crank assembly includes a crank arm 94 and a crank pin 96 having an inner portion 98 and a shaft portion 100. The inner end (not shown) of crank arm 94 is secured to one of support members 18 in a known manner.

The roller hanger assembly 26 includes a hanger housing 102 having a pair of appropriately oriented rollers 104 rotatably mounted thereto for rolling movement along the track 22 in a known manner. The body of the roller hanger assembly includes a smooth walled cylindrical channel or well 106 penetrating thereinto for closely rotatably receiving an axial section of shaft portion 100 therein. The longitudinal axis of well 106 is disposed substantially normal to the axis of rotation of rollers 104.

Figure 4:
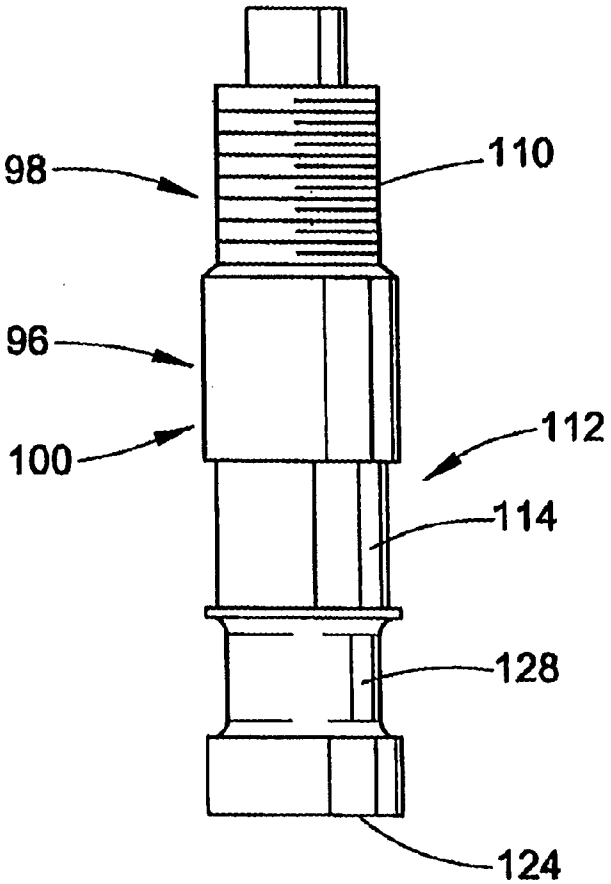
Figure 3:
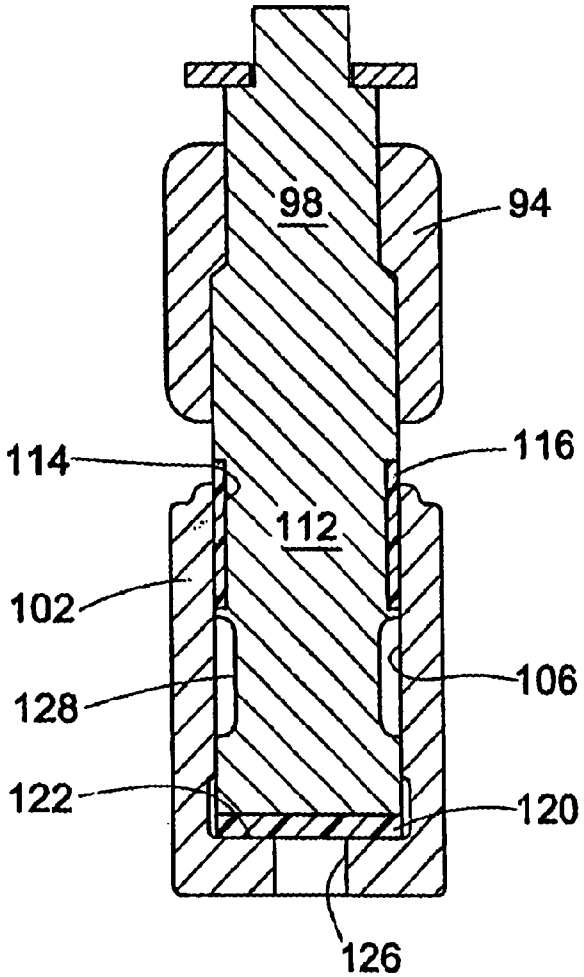
FIG. 3 is a cross-sectional view taken along lines 3—3 of FIG. 2; and, FIG. 4 is an elevational view of a crank pin of the greaseless crank assembly shown in FIG. 2.

With reference to FIGS. 3 and 4 as well as with general reference to FIG. 2, the crank pin inner portion 98 includes a threaded portion or section 110 secured to the outer end of the crank arm 94, and shaft portion 100 has a lower portion 112 physically housed within well or channel 106. Preferably, the lower portion 112 of the shaft 100 includes a centrally located peripherally recessed portion 114 along an axial segment thereof which is adapted to closely receive a self-lubricating sleeve 116 therearound.

In one embodiment, the sleeve is heat shrunk around the recessed portion of the shaft. Alternately, the sleeve may be split in a generally longitudinal manner, and then wrapped around and secured in recessed portion 114 using conventional epoxy or other connecting means. The method of sleeve installation is determined primarily by the character of the sleeve material selected for use.

In a preferred arrangement, the self-lubricating sleeve 116 is comprised of a high-density polyethylene material (HDPE) which advantageously provides a self-lubricating surface to act as an effective substitute for the grease found in conventional crank and roller hanger assembly fittings. The polyethylene material provides low friction or self-lubricating surfaces which enable the crankshaft to rotate freely within the channel or well. Preferably, the HDPE has a molecular weight in the range of 200,000 to 500,000. While polyethylene is the preferred sleeve material, it must be appreciated that other materials having similar characteristics for replacing grease may also be satisfactorily used.

The roller hanger assembly 26 also includes at least one self-lubricating annular member or washer 120 disposed in well or channel 106 in facing contact with bottom wall 122 thereof. The lower portion 112 of shaft 100 is rotatably disposed in cooperating relation with the well such that the outer terminal end face 124 of the shaft portion is in contact with annular member or washer 120. In addition, at least a significant longitudinal portion, and preferably all, of the self-lubricating sleeve 116 is in close rotational contacting relation with the side wall of channel or well 106. A through opening 126 extends from bottom wall 122 to the exterior of roller hanger assembly housing 102 in a coaxial relationship relative to well 106. Lower portion 112 of shaft 100 also includes a peripheral clearance band 128 intermediate recessed portion 114 and end face 124.

Preferably, the self-lubricating annular member or washer 120 disposed against bottom wall 122 of the well is also made from a high-density polyethylene material. When this material is used, a single annular member or washer 120 is most preferred. In another arrangement, plural oil impregnated bronze washers disposed in a face to face stacked relationship are satisfactorily employed. It is to be appreciated that other suitable materials for replacing grease may also be used and that the number of annular members or washers may be varied as necessary or desired.

The foregoing crankshaft and roller hanger assembly effectively eliminates the need for grease as a lubricant for the rotatable crank pin. The use of a sleeve and annular member made from a self-lubricating material enables the crank pin 96 to rotate freely without the use of grease. Therefore, the difficulties previously associated with sealing, maintaining and monitoring grease-filled roller hanger assembly fittings are successfully and advantageously eliminated.

The invention has been described with reference to the preferred embodiment. Obviously, modifications and alterations will occur to others upon a reading and understanding of the detailed description. It is intended that the invention be construed as including all such modifications and alterations in so far as they come within the scope of the appended claims or the equivalence thereof.

Having thus described the preferred embodiment, the invention is now claimed to be:

1. In a railcar door including a substantially planar door, a pair of elongated support members rotatable mounted to said door, upper and lower crank assemblies secured to each support member, said lower crank assemblies each including a crank pin rotatable received by a roller hanger assembly, a greaseless method of rotatable mounting said crank pin to an associated roller hanger assembly comprising the steps of:

substantially surrounding a shaft portion of said crank pin with a sleeve comprised of a self-lubricating material, and placing said sleeve in surrounding relation to a peripherally extending recess in said shaft portion at an area axially spaced from said end face; and, heat shrinking said sleeve in close spaced surrounding relation to said recess;

positioning a member comprised of a self-lubricating material against the bottom wall of an elongated well in a body of said roller hanger assembly; and, positioning said crank pin shaft portion with said sleeve in close rotational cooperation with said well such that an outer end face of said shaft portion is in contacting relation with said member and at least an axial portion of said sleeve is in contacting relation with a side wall of said well.

2. The A railcar door assembly comprising:

a substantially planar door;

at least one elongated support member rotatable mounted to said door;

a drive mechanism operatively connected to said elongated support member for selectively rotating said support member about its length;

a crank disposed at least adjacent an end of said support member and being rotatable therewith, said crank including a crank pin;

a roller assembly operatively secured to said crank pin to facilitate relative rotation therebetween about an axis normal to the axis of rotation of a roller associated with said roller assembly; and, said crank pin including a shaft portion received in a well defined in said roller assembly, said shaft portion having a peripherally recessed area therearound with a self-lubricating sleeve received therein, said shaft portion with said sleeve being closely received in said well for selective rotational movement therein during opening and closing of said door wherein said well in said roller assembly has a side wall and a bottom wall and said shaft portion of said crank pin has an end face, at least one self-lubricating member being interposed between said bottom wall and said end face.

3. The railcar door assembly according to claim 2 wherein said self-lubricating sleeve is comprised of a high-density polyethylene material.

4. The railcar door assembly according to claim 2 wherein said at least one self-lubricating member is comprised of a high-density polyethylene material.

5. The railcar door assembly according to claim 2 wherein said self-lubricating annular member is comprised of two oil-impregnated members disposed in a face to face relationship with each other.

6. The railcar door assembly according to claim 2 wherein said bottom wall has an opening extending therethrbugh to the exterior of said roller assembly and said self-lubricating member has a generally annular conformation.

7. The railcar door assembly according to claim 6 wherein said through opening is generally coaxial with said wall.

8. A greaseless connection between a crank assembly and a roller hanger assembly used for movably supporting a railcar door on a track, said connection comprising:

said crank assembly including a crank pin with a shaft portion having an elongated body with an outer terminal end and a peripherally extending recess axially spaced therealong from said outer terminal end, and a self-lubricating sleeve closely received in said peripheral recess;

said roller hanger assembly including a housing having an elongated well dimensioned to closely rotatably receive said shaft portion with said sleeve, said well having a bottom wall; and, at least one self-lubricating member interposed between said bottom wall and said shaft portion outer terminal end.

9. The greaseless connection according to claim 8 wherein said self-lubricating member comprises a pair of oil-impregnated members disposed in a face to face relationship with each other.

10. The greaseless connection according to claim 8 wherein said self-lubricating member is comprised of a high-density polyethylene material.

11. The greaseless connection according to claim 8 wherein said sleeve is comprised of a high-density polyethylene material.

12. The greaseless connection according to claim 8 wherein an opening communicates between said bottom wall and the exterior of said roller hanger assembly.

13. The greaseless connection according to claim 12 wherein said opening is generally coaxial with said wall and said self-lubricating member has an annular conformation.

* * * * *